US005575344A

United States Patent [19]

Wireman

[11] Patent Number: 5,575,344

[45] Date of Patent: Nov. 19, 1996

[54] ROD CHANGING SYSTEM

[75] Inventor: Alonzo Wireman, Sherman, Tex.

[73] Assignee: Reedrill Corp., Sherman, Tex.

[21] Appl. No.: 439,858

[22] Filed: May 12, 1995

[51] Int. Cl.[6] ..... E21B 19/15

[52] U.S. Cl. ..... 175/85; 175/162; 414/22.71

[58] Field of Search ..... 175/85, 52, 162; 414/22.71, 22.51, 22.68

[56] References Cited

U.S. PATENT DOCUMENTS

| | | | |
|---|---|---|---|
| 3,920,087 | 11/1975 | Hisey et al. | 175/85 X |
| 4,128,135 | 12/1978 | Mitchhart et al. | 175/52 |
| 4,403,666 | 9/1983 | Willis | 175/85 |
| 4,595,066 | 6/1986 | Nelmark et al. | 175/85 |
| 4,738,321 | 4/1988 | Olivier | 175/85 |
| 4,765,401 | 8/1988 | Boyadjieff | 175/52 X |
| 5,297,642 | 3/1994 | Rajakallio et al. . | |
| 5,375,667 | 12/1994 | Trevisani | 175/52 |
| 5,437,527 | 8/1995 | McGill et al. | 414/22.51 |

*Primary Examiner*—Frank Tsay
*Attorney, Agent, or Firm*—David H. Judson

[57] ABSTRACT

A drill rod changing apparatus is disclosed including a support assembly connected to a drilling rig for supporting a plurality of drill rods. Connected to the support assembly is a lifting mechanism for raising and lowering a drill rod along the longitudinal axis of a drill string. Movement of the drill rod along the longitudinal axis of the drill string is assisted by a gripping assembly which engages a drill rod integrated with the lifting mechanism. The gripping assembly further assists in threading or unthreading adjacent coupling connections to the drill rod by preventing rotation of the drill rod while an adjacent connection is unthreaded. The apparatus further enables rotation of a gripped drill rod from a first position at the drill string to a second storage position.

19 Claims, 4 Drawing Sheets

ROD CHANGING SYSTEM

TECHNICAL FIELD

The present invention relates to drilling equipment, and more particularly, to an apparatus for changing drill rods within a drill string of a drilling rig.

BACKGROUND OF THE INVENTION

Due to the adverse environmental conditions existing around drilling operations, drilling equipment is normally provided with operator cabs to separate the operator from the noise and dust of the drilling operations. Most drilling operations further require that drill extension rods be added to a drill string in order to enable the drill bit to reach a required drilling depth. When an operator is within a cab, he is unable to manually add drill rods to the drill string. Furthermore, in many drilling applications, the drill rod is too heavy for the operator to lift manually. These conditions have created the need for automated rod changing systems.

One type of presently existing automated rod changing system utilizes a separate rotating system to unthread the drill rod and coupling from adjacent drill rods in the drill string. These types of systems require a great deal of additional hardware causing the system to be very expensive. Other rod changing systems utilize the rotating system of a percussive drill to unthread the drill rod and coupling from the drill string. With these type of rod changing systems, the drill rod must be securely held while the percussive drill threaded element is threaded into the upper coupling on the drill rod. This operation enables the upper coupling, drill rod and percussive drill threaded element to rotate as a single element and unthreaded from the lower coupling when a drill rod is removed from the drill string.

After unthreading from the lower coupling, the upper coupling must be loosened from the percussive drill threaded element so that the drill rod and upper coupling can be moved to a storage area. Current designs in the industry use a separate break-out wrench to grip the upper coupling while the percussive drill threaded element is threaded or unthreaded from the coupling. The separate break-out wrench is mounted on the drill mast, feed-column, or the percussive drill mounting plate. In all of these cases, the extra break-out wrench assembly is expensive and requires additional maintenance for the drilling machine.

When the break-out wrench is mounted on the drill mast, the operator is also required to position the coupling in the area of the break-out wrench to perform the loosening operation. Another problem with current designs comes from the requirement of complicated, expensive components required to transfer the drill rod assembly from the drill string to the storage area. Therefore, a rod changing system incorporating more efficient methods for breaking loose threaded connections between drill rods and better capacities for transferring a drill rod between the drill string and a storage area is needed.

SUMMARY OF THE INVENTION

The present invention overcomes the foregoing and other problems with a new and improved drill rod changing system. The drill rod changing system comprises upper and lower support arms connected to the drill feed and extending outward therefrom. Mounted to the upper support arm is a lifting apparatus enabling drill rods to be lifted between lowered and raised positions. The lifting assembly includes an upper gripping assembly for gripping the drill rod around the upper coupling of the drill rod. A lower gripping assembly grips the lower portion of the drill rod Once grasped by the upper and lower gripping assemblies, threaded connections at either end of the drill rod may be threaded or unthreaded depending on whether the rod is being loaded into or removed from the drill string. An actuator mounted to the lower support arm enables a gripped drill rod to be moved between a first position coaxial with the drill stem to a second storage position where the drill rod may be stored.

The foregoing has outlined some of the more pertinent aspects of the present invention. These aspects should be construed to be merely illustrative of some of the more prominent features and applications of the inventions. Many other beneficial results can be claimed by applying the disclosed invention in a different manner or modifying the invention as will be described. Accordingly, other aspects and a fuller understanding of the invention may be had by referring to the following detailed description of the preferred embodiment.

BRIEF DESCRIPTION OF THE DRAWINGS

For a more complete understanding of the present invention and the advantages thereof, reference should be made to the following detailed description taken in conjunction with the accompanying drawings in which.

DETAILED DESCRIPTION

Figure 1:
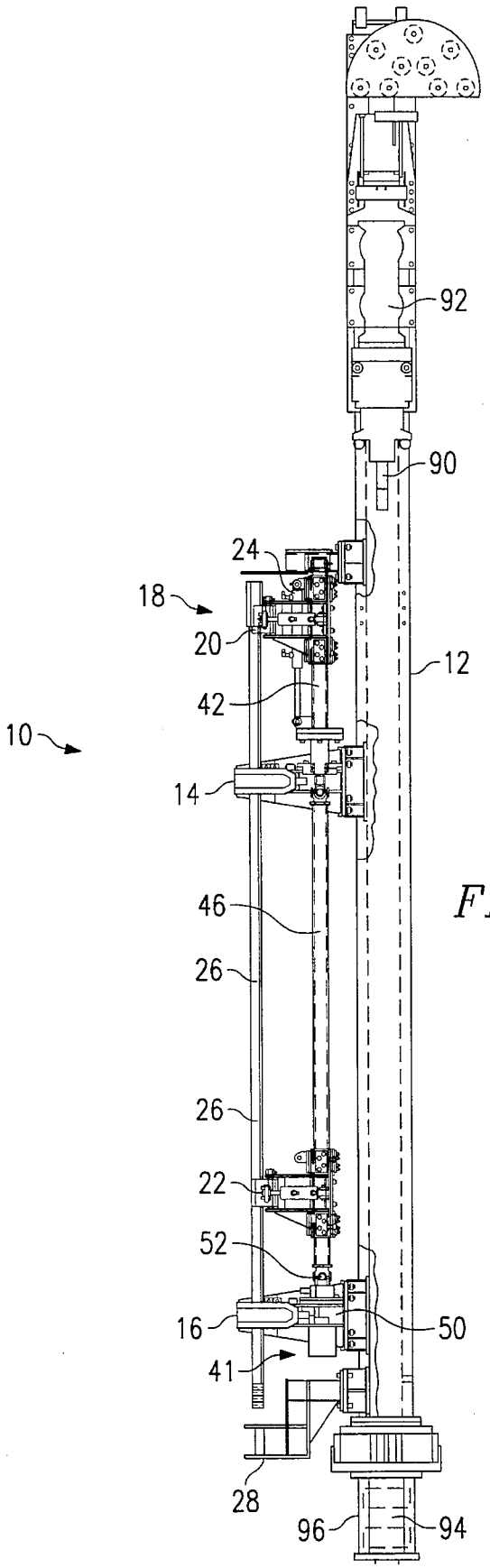
FIG. 1 is a front view of the rod changing system of the present invention.

Referring now to the drawings, and more particularly to FIG. 1, there is illustrated a front view of the rod changing system of the present invention. The rod changing system 10 is connected to the drill mast 12 via the upper rod support assembly 14 and lower rod support assembly 16. The upper rod support assembly 14 and lower rod support assembly 16 assist in guiding and supporting a drill rod 24 to storage rack 28. The transfer assembly 18 is mounted to the upper and lower rod support assemblies and consists of the upper gripper assembly 20, lower gripper assembly 22, and lifting mechanism 24.

A rotator assembly 41 consists of upper drive shaft 42 connected to lower drive shaft 46 via a universal joint 48. The lower drive shaft 46 further connects by a universal joint 52 to a motor assembly 50 mounted on lower support arm 16. The motor assembly 50 preferably comprises a rack and pinion rotator but may comprise any means suitable for rotating the upper and lower drive shafts 42, 48. The motor assembly 50 rotates the upper and lower drive shafts 42, 48 causing the gripper assemblies 20, 22 to rotate in an arcuate path and move a gripped drill rod 26 from a position adjacent the drill string to a storage position.

Figure 2:
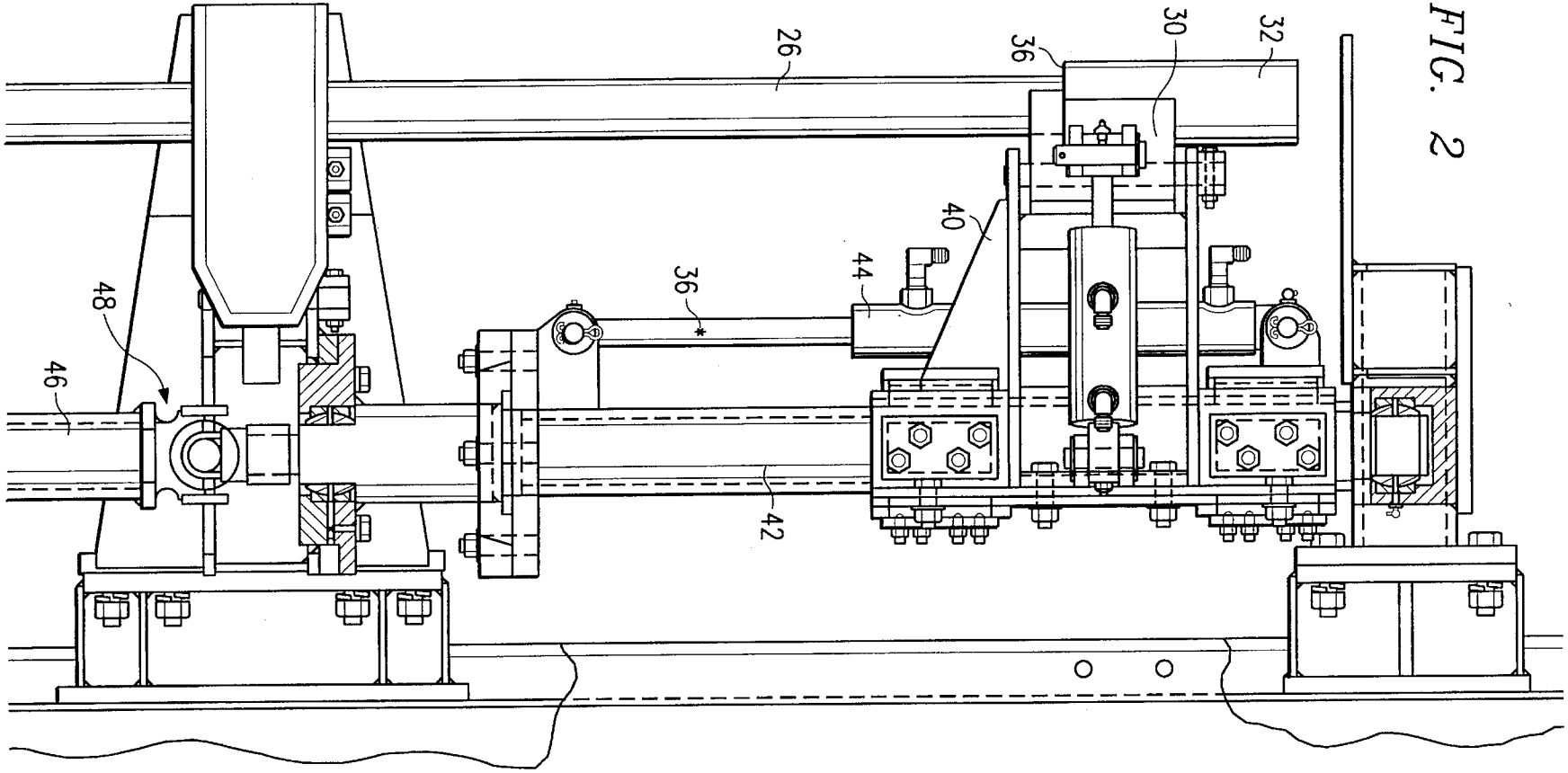
FIG. 2 is a side view of the upper gripper assembly and the lifting mechanism.
Figure 3:
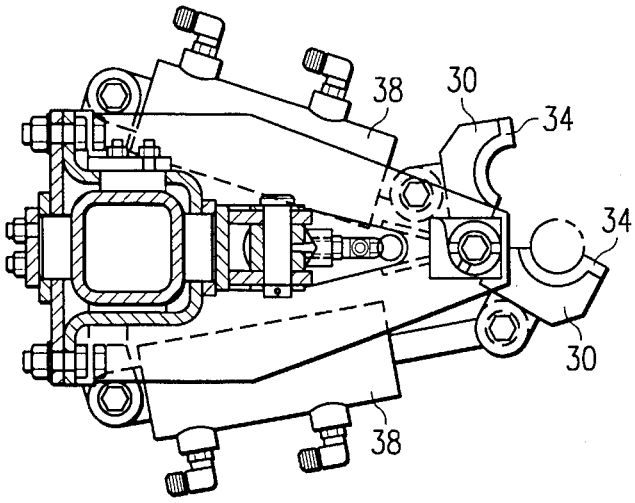
FIG. 3 is a top view of the upper gripper assembly.

Referring now also to FIGS. 2 and 3, there is more fully illustrated the upper gripper assembly 20 and lifting mechanism 24. The upper gripper assembly 20 consists of a pair of opposed jaws 30 pivotally connected to the upper mounting bracket 40 for gripping the upper coupling 32 of the drill rod 26. When closed, the jaws 30 provide a seat 34 for retaining the bottom edge 36 of upper coupling 32. This allows the upper gripper assembly 20 to retain the drill rod 26 and upper coupling 32 when clamped. Each jaw 30 is actuated by a hydraulic actuator 38 connecting the jaw 30 to the upper mounting bracket 40. The hydraulic actuator 38 actuates the jaws to a gripping position for tightly holding the upper coupling and drill rod to prevent their rotation during unthreading/threading procedures and to a support position for holding the upper coupling 32 to enable lifting of the drill rods 26 but still allowing rotation of the upper coupling and drill rod within the upper gripper assembly 20.

Upper mounting bracket 40 is connected to upper drive shaft 42 such that the bracket may slide up and down the shaft. Movement of the bracket 40 and upper gripper assembly 20 is enabled by hydraulic lift actuator 44. The lift actuator 44 couples the upper drive shaft 42 to the upper mounting bracket 40. Lift actuator 44 enables the upper gripper assembly 20 to be moved from a lowered position located generally at 36 to a raised position as shown in FIG. 3 by raising or lowering the upper mounting bracket 40. This allows a drill rod 26 to be raised and lowered as required.

Figure 4:
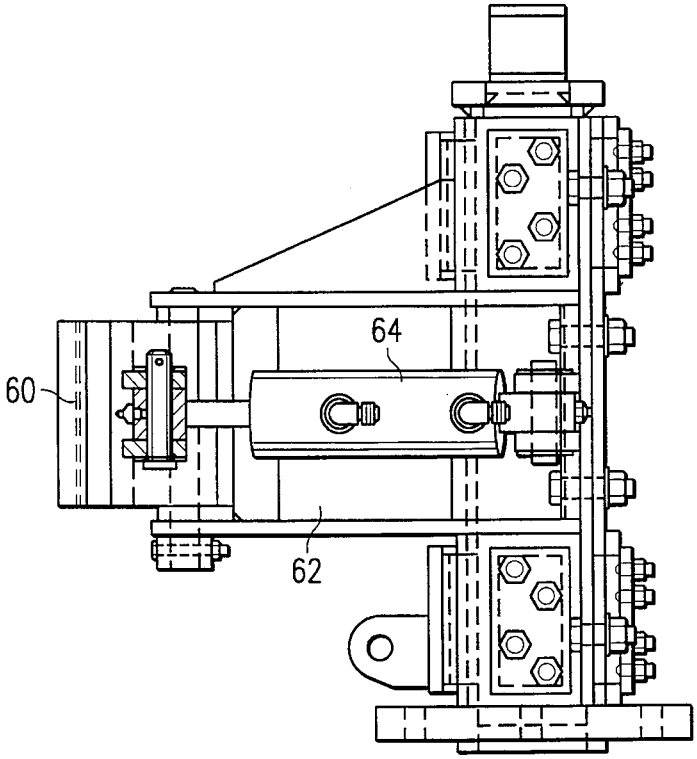
FIG. 4 is a side view of the lower gripper assembly.
Figure 5:
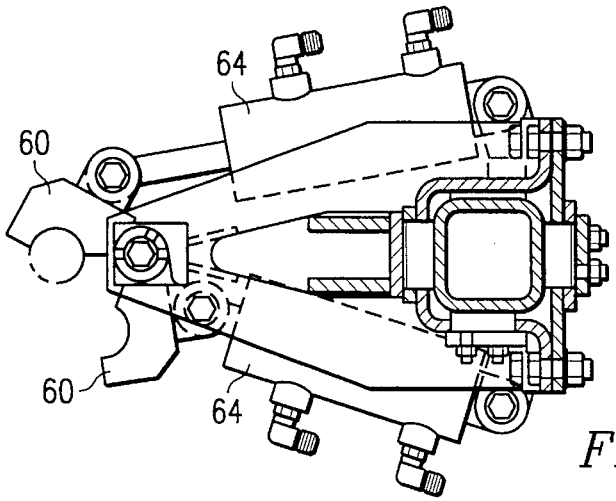
FIG. 5 is a top view of the lower transfer assembly.

Referring now also to FIGS. 4 and 5, there are illustrated side and top views of the lower gripper assembly 16. The lower gripper assembly 22 comprises a pair of opposed jaws 60 for clamping around the lower portion of a drill rod 26. The jaws 60 are pivotally connected to a lower mounting bracket 62 which is connected to the lower drive shaft 46. The jaws 60 are actuated by hydraulic actuators 64 connected to the jaws and the lower mounting bracket 62. The hydraulic actuators 64 actuate the jaws to a gripping position for tightly holding the drill rod 26 to prevent rotation of the drill rod and to a support position to support the drill rod but still enable rotation of the drill rod within the lower gripper assembly 22.

Figure 6:
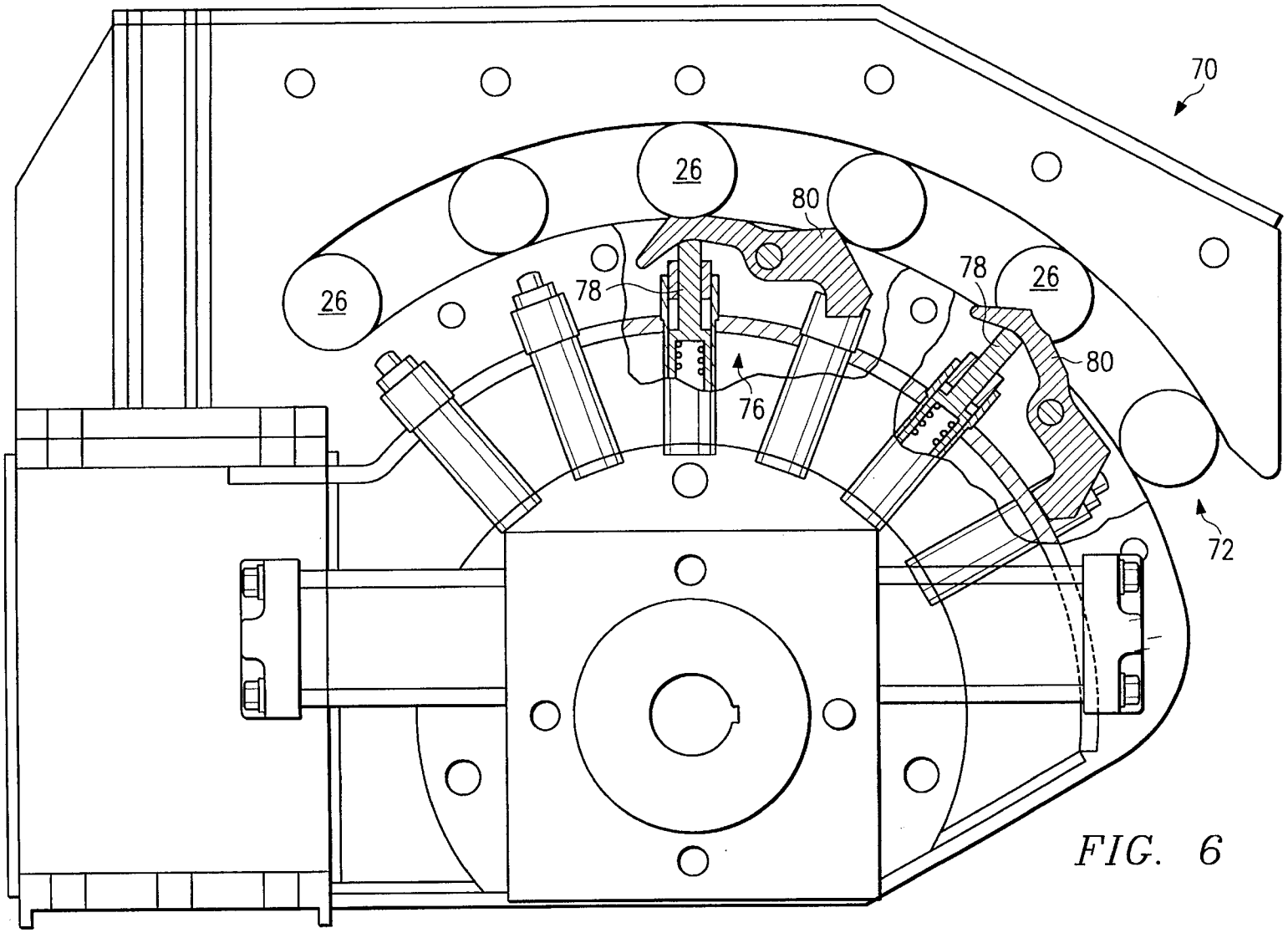
FIG. 6 is a top view of the support assembly.

Referring now to FIG. 6, there is illustrated a top view of an upper or lower support assembly 70. It is to be noted that the construction of both the upper and lower support assemblies are in a similar manner. The support assembly 70 provides a slot 72 for containing a plurality of drill rods 26 that are being loaded into or removed from the drill string. The support assembly 70 spaces the drill rods 26 apart and retains them in a stable position. The drill rods 26 are spaced apart and held in place by a spacing mechanism 76. The spacing mechanism 76 comprises a spring-loaded piston 78 and rocker arm 80. The rocker arm 80 separates the drill rods 26 and maintains them in a storage position. Oversized mounting holes and shims allow the support assemblies to hold various size drill rods such as 38 millimeter, 45 millimeter or 51 millimeter drill rods.

Referring back to FIG. 1, the procedure for adding a drill rod to the drill string proceeds in the following manner. A drill rod 26 within the storage rack 28 is gripped by actuating the jaws of the upper and lower gripper assemblies 20, 22 to the gripping position. The lifting mechanism 24 is actuated to lift the drill rod 26 to the raised position. The rotation assembly 41 swings the drill rod 26 into position under the threaded striking bar 90 of the drill head 92 such that the drill rod is coaxial with the drill string. The drill rod 26 is lowered by the lifting mechanism 24 into the upper coupling of a drill rod 94 at the top of the drill string held by the centralizer 96. While still maintaining the gripping position on the drill rod 26 with the gripper assemblies 20, 22, the threaded striking bar 90 is threaded into the upper coupling of the drill rod. The gripping assemblies are then actuated to the holding position, and the drill rod 26 is threaded onto the upper upper coupling of the adjacent drill rod 94 located in the centralizer by the striking bar 90. The lifting mechanism 18 lowers the drill rod 26 as the rod is threaded into the upper coupling of the adjacent drill rod 94.

When removing a drill rod 26 from the drill string, the gripper assemblies 20, 22 of the rod changer are positioned about a drill rod with the upper gripper assembly 20 supporting the upper coupling of the drill rod and the lower gripper assembly 22 supporting the lower portion of the drill rod. The opposed jaws 30 of the gripping assemblies 20, 22 are actuated to the gripping position on the drill rod 26 so that the threaded striking bar 90 may be threaded into the upper coupling. The opposed jaws 30 are then relaxed to the support position to enable rotation of the drill rod 26 while the drill rod is unthreaded from the coupling of the drill rod 94 locked in the centralizer 96. The lifting mechanism 24 of the rod changer enables the drill rod 26 to follow the upper coupling upward as the drill rod threads out of the coupling of the drill rod 94 locked in the centralizer 96. When the drill rod 26 clears the coupling of the drill rod 94 locked in the centralizer 96, the opposed jaws 30 of the gripper assemblies 20, 22 are again actuated to a gripping position to enable the threaded striking bar 90 to be unthreaded from the upper coupling of the drill rod 26. The rotator assembly 41 is then actuated to position the drill rod 26 over the storage rack 28 and lift mechanism 18 is actuated to lower the drill rod into the storage rack 28.

It should be appreciated by those skilled in the art that the specific embodiments disclosed above may be better utilized as a basis for modifying or designing structures for carrying out the purposes of the present invention. It should also be realized by those skilled in the art that the above instructions do not depart from the spirit and scope of the invention as set forth in the appended claims.

What is claimed is:

1. A drill rod changer for use with a drilling rig, the drilling rig having a drill string including a plurality of threadedly connected drill rods, comprising:

a support assembly mounted to the drilling rig for supporting a drill rod;

a lifting assembly mounted to the support assembly for raising and lowering the drill rod along a longitudinal axis of the drill string;

a gripping assembly integrated with the lifting assembly for engaging the drill rod to enable loosening of threaded connections with the drill rod and to assist in movement of the drill rod along the longitudinal axis of the drill string; and means for rotating the grip assembly from a first position coaxial with the drill string to a second storage position.

2. The drill rod changer of claim 1 wherein the support assembly includes upper and lower support arms for supporting the drill rod.

3. The drill rod changer of claim 1 further including a storage rack for storing the drill rod in the storage position.

4. The drill rod changer of claim 1 wherein the lifting assembly comprises a hydraulic actuator.

5. The drill rod changer of claim 1 wherein the gripping assembly comprises:

a first gripping arm extending from the lifting assembly;

a pair of opposed jaws pivotally connected to the first gripping arm for gripping the drill rod.

6. The drill rod changer of claim 5 wherein the pair of opposed jaws provide a seat for an upper coupling of the drill rod.

7. The drill rod changer of claim 5 further including:

a second gripping arm below the first lifting arm; and a pair of opposed jaws pivotally connected to the second gripping arm for gripping the drill rod.

8. The drill rod changer of claim 1 wherein the means for rotating comprises a rack and pinion rotator.

9. The drill rod changer of claim 1 wherein the support assembly supports a variety of drill rod sizes.

10. The drill rod changer of claim 1 wherein the gripper assembly may engage a variety of drill rod sizes.

11. A drill rod changer for use with a drilling rig, the drilling rig having a drill string including a plurality of threadedly connected drill rods, comprising:

upper and lower support arms for supporting a drill rod;

a lifting assembly mounted to the upper support arm for raising and lowering the drill rod along a longitudinal axis of the drill string;

an upper gripping assembly mounted to the lifting means for engaging a coupling of the drill rod to enable loosening of threaded connections with the drill rod and to assist in movement of the drill rod along the longitudinal axis of the drill string;

a lower gripping assembly mounted to the lower support arm for gripping the drill rod to enable loosening of threaded connections with the drill rod and to assist in movement of the drill rod along the longitudinal axis of the drill string; and means for rotating the upper and lower gripping assemblies from a first position at the drill string to a second storage position.

12. The drill rod changer of claim 11 further including a storage rack for storing the drill rod in the storage position.

13. The drill rod changer of claim 11 wherein the lifting assembly comprises a hydraulic actuator.

14. The drill rod changer of claim 11 wherein the upper and lower gripping assemblies comprise:

a gripping arm extending from the lifting assembly;

a pair of opposed jaws pivotally connected to the first gripping arm for gripping the drill rod; and means for actuating the pair of opposed jaws.

15. The drill rod changer of claim 11 wherein the means for rotating comprises:

a drive shaft connected to the upper and lower gripper assemblies; and a rack and pinion rotator for rotating the drive shaft.

16. The drill rod changer of claim 11 wherein the support assembly supports a variety of drill rod sizes.

17. The drill rod changer of claim 11 wherein the upper and lower gripper assemblies may engage a variety of drill rod sizes.

18. A drill rod changer for use with a drilling rig, the drilling rig having a drill string including a plurality of threadedly connected drill rods, comprising:

a support assembly mounted to the drilling rig for supporting a drill rod;

a lifting assembly mounted to the support assembly for raising and lowering the drill rod along a longitudinal axis of the drill string; and a gripping assembly integrated with the lifting assembly for engaging the drill rod to enable loosening of threaded connections with the drill rod.

19. The drill rod changer of claim 1 wherein the support assembly further includes means for supporting and separating a plurality of drill rods unthreaded from the drill string.

* * * * *